US011636799B2

(12) United States Patent
Hu et al.

(10) Patent No.: US 11,636,799 B2
(45) Date of Patent: Apr. 25, 2023

(54) DISPLAY METHOD, DISPLAY PANEL AND DISPLAY CONTROL DEVICE

(71) Applicant: YUNGU (GU'AN) TECHNOLOGY CO., LTD., Hebei (CN)

(72) Inventors: Fengzhang Hu, Langfang (CN); Tianzhen Zhou, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 17/981,659

(22) Filed: Nov. 7, 2022

(65) Prior Publication Data

US 2023/0064991 A1 Mar. 2, 2023

Related U.S. Application Data

(63) Continuation of application No. PCT/CN2021/089699, filed on Apr. 25, 2021.

(30) Foreign Application Priority Data

Jul. 27, 2020 (CN) ..... 202010733286.X

(51) Int. Cl.
*G09G 3/20* (2006.01)

(52) U.S. Cl.
CPC ..... *G09G 3/2007* (2013.01); *G09G 3/20* (2013.01); *G09G 2310/027* (2013.01); *G09G 2320/0233* (2013.01); *G09G 2320/0673* (2013.01)

(58) Field of Classification Search
None
See application file for complete search history.

(56) References Cited

U.S. PATENT DOCUMENTS

2008/0224975 A1 9/2008 Lee et al.
2017/0061889 A1 3/2017 Seo et al.
2020/0135147 A1* 4/2020 Tang ..... G09G 3/3208

FOREIGN PATENT DOCUMENTS

CN 101650923 A 2/2010
CN 105096896 A 11/2015
(Continued)

OTHER PUBLICATIONS

International Search Report (including English translation) and the Written Opinion dated Jul. 30, 2021 in corresponding International Application No. PCT/CN2021/089699, 12 pages.
(Continued)

*Primary Examiner* — Chad M Dicke
(74) *Attorney, Agent, or Firm* — Maier & Maier, PLLC

(57) ABSTRACT

A display method, a display panel, a display control device, a storage medium and a product, where the display method includes: performing, according to a display area to which a data to be displayed belongs, a gray-scale conversion on the data to be displayed to obtain a gray-scale value of the data to be displayed; performing mapping on the gray-scale value of the data to be displayed corresponding to the first display area and the gray-scale value of the data to be displayed corresponding to the second display area respectively by using different gamma curves to obtain a first display voltage and a second display voltage; and controlling the first display area and the second display area of the display panel to display according to the first display voltage and the second display voltage.

10 Claims, 5 Drawing Sheets

(56) References Cited

FOREIGN PATENT DOCUMENTS

| | | | |
|---|---|---|---|
| CN | 105632425 | A | 6/2016 |
| CN | 106875916 | A | 6/2017 |
| CN | 107331350 | A | 11/2017 |
| CN | 107665666 | A | 2/2018 |
| CN | 109584818 | A | 4/2019 |
| CN | 110444178 | A | 11/2019 |
| CN | 110634434 | A | 12/2019 |
| CN | 110675818 | A | 1/2020 |
| CN | 110767136 | A | 2/2020 |
| CN | 110767138 | A | 2/2020 |
| CN | 111161678 | A | 5/2020 |
| CN | 111179798 | A | 5/2020 |
| CN | 111192554 | A | 5/2020 |
| CN | 111192902 | A | 5/2020 |
| CN | 111862875 | A | 10/2020 |
| KR | 20020092075 | A | 12/2002 |
| KR | 20170090555 | A | 8/2017 |

OTHER PUBLICATIONS

Chinese Office Action dated Sep. 29, 2021 in corresponding Chinese Application No. 202010733286.X, 12 pages (including partial English translation).

Chinese Office Action dated Dec. 6, 2021 in corresponding Chinese Application No. 2202010733286.X, 11 pages (including partial English translation).

Chinese Notice of Allowance dated Feb. 16, 2022 in corresponding Chinese Application No. 202010733286.X, 4 pages.

* cited by examiner

DISPLAY METHOD, DISPLAY PANEL AND DISPLAY CONTROL DEVICE

CROSS-REFERENCE TO RELATED APPLICATION

This application is a continuation of International Application No. PCT/CN2021/089699, filed on Apr. 25, 2021, which claims priority to Chinese patent application No. 202010733286.X, filed on Jul. 27, 2020 to China National Intellectual Property Administration and entitled "DISPLAY METHOD, DISPLAY PANEL, DISPLAY CONTROL DEVICE AND STORAGE MEDIUM". The afore-mentioned patent applications are hereby incorporated by reference in their entireties.

TECHNICAL FIELD

The present application relates to the field of display technology and, in particular, to a display method, a display panel and a display control device.

BACKGROUND

With the development and maturity of display technology, an under-display camera is installed on a display panel to increase the display size of the display panel.

Generally, in order to ensure a normal operation of the under-display camera, a certain display transmittance will be increased for a display area where the under-display camera is installed on the display panel, while a display luminescence will be decreased.

However, such an arrangement will cause low brightness and poor visual effects to be presented in a display image of the display area where the under-display camera is installed compared with other display areas where no under-display camera is installed.

SUMMARY

In view of the above problems, the present application provides a display method, a display panel and a display control device, which can improve the display quality of the display panel by controlling display voltages in different display areas.

In a first aspect, the present application discloses a display method applicable to a display panel including a first display area and a second display area;

the display method includes:

performing, according to a display area to which a data to be displayed belongs, a gray-scale conversion on the data to be displayed to obtain a gray-scale value of the data to be displayed;

performing mapping on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage; and controlling the first display area and the second display area of the display panel to display according to the first display voltage and the second display voltage.

In a second aspect, the present application discloses a display control device configured to control a display panel to display, where the display panel includes a first display area and a second display area;

the display control device includes:

a data processing unit, configured to perform, according to a display area to which a data to be displayed belongs, a gray-scale conversion on the data to be displayed to obtain a gray-scale value of the data to be displayed;

a voltage output unit, configured to perform mapping on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage; and a control unit, configured to control the first display area and the second display area of the display panel to display according to the first display voltage and the second display voltage.

In a third aspect, the present application discloses a display panel including:

a substrate, including a first display area and a second display area; and a controller, configured to control the first display area and the second display area on the substrate to display by using the display method according to the first aspect.

In a fourth aspect, the present application discloses a display panel, which includes at least one processor and a memory;

the memory stores computer-executable instructions;

the at least one processor executes the computer-executable instructions stored in the memory, so that the at least one processor executes the display method according to the first aspect.

In a fifth aspect, the present application discloses a computer-readable storage medium, where the computer-readable storage medium stores a computer-executable instruction, and when a processor executes the computer-executable instruction, the display method according to the first aspect is implemented.

In a sixth aspect, the present application also provides a computer program product including computer instructions for causing a computer to perform the display method as described above.

The present application provides a display method, a display panel, a display control device, a storage medium and a product, where the display panel includes a first display area and a second display area, and the display method includes performing, according to a display area to which a data to be displayed belongs, a gray-scale conversion on the data to be displayed to obtain a gray-scale value of the data to be displayed; performing mapping on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage; and controlling the first display area and the second display area of the display panel to display according to the first display voltage and the second display voltage, so that the display brightness of the first display area is the same as or similar to that of the second display area. By performing the gray-scale conversion on the data to be displayed, for the gray-scale values of the data to be displayed in different display areas on the display panel, the different gamma curves are adopted to perform mapping on the gray-scale values, so as to obtain display voltages available for controlling the display brightness of the display areas. By adopting such a partitioned display control method, it can effectively ensure that a same or similar level of display brightness is maintained for different display areas, especially for a display panel installed with an under-display camera, the display quality is significantly improved.

BRIEF DESCRIPTION OF THE DRAWINGS

The drawings herein are incorporated into and constitute a part of this specification, which illustrate embodiments consistent with the present application and are used together with this specification to explain the principles of the present application.

Through the above-mentioned drawings, specific embodiments of the present application have been shown, and will be described in more detail hereinafter. These drawings and text descriptions are not intended to limit the scope of the concepts of the present application in any way, but to illustrate the concepts of the present application to those skilled in the art with reference to specific embodiments.

DETAILED DESCRIPTION OF THE EMBODIMENTS

Herein, exemplary embodiments will be described in detail, examples of which are shown in the accompanying drawings. When the following description refers to the drawings, unless otherwise indicated, the same numbers in different drawings indicate the same or similar elements. The implementations described in the following exemplary embodiments do not represent all the implementations consistent with the present application. On the contrary, they are only examples of devices and methods consistent with some aspects of the present application as detailed in the appended claims.

With the development and maturity of display technology, it is possible to install an under-display camera on a display panel to increase the display size of the display panel.

Generally, in order to ensure a normal operation of the under-display camera, a certain display transmittance will be increased for a display area where the under-display camera is installed on the display panel, while a display luminous rate luminescence will be decreased.

Figure 1:
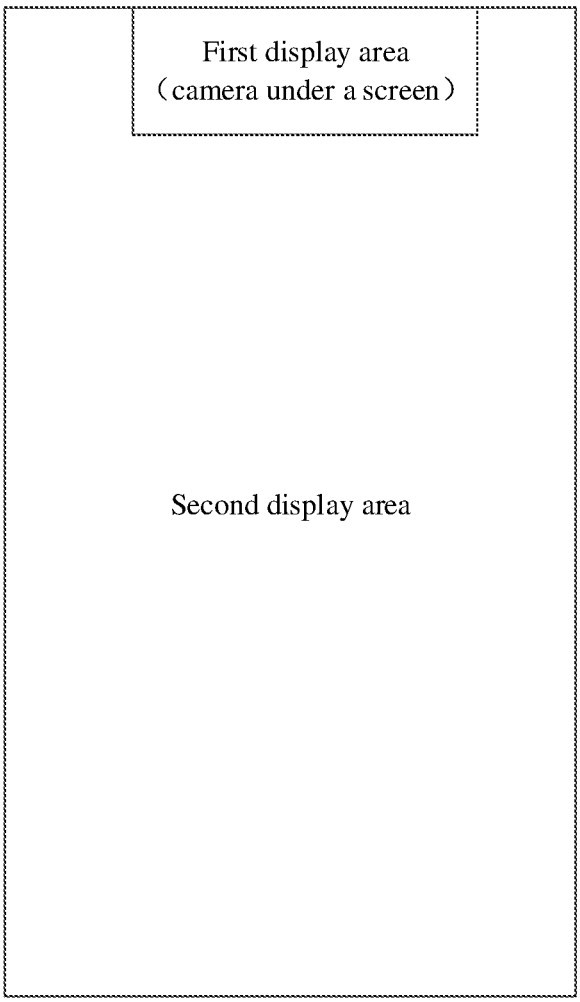
FIG. 1 is a schematic diagram of an interface of a display panel in the prior art.

FIG. 1 is a schematic diagram of an interface of a display panel in the prior art. As shown in FIG. 1, in the existing display panel, in order to increase the display size as much as possible, an under-display camera will be arranged in part of the display panel, such as a first display area at the top of the display panel as shown in FIG. 1; in addition, the area where no under-display camera is arranged is a second display area in FIG. 1, where in the first display area where the under-display camera is arranged, light emission and displaying are still possible on the panel. Therefore, both the first display area and the second display area can be used for content display, which increases the display size of the display panel.

In order to ensure the normal operation of the under-display camera to obtain external images, the first display area where the under-display camera is arranged is usually set to be transparent. Correspondingly, the light transmittance of the first display area is greatly improved, while the luminescence of the first display area is correspondingly reduced. However, the above arrangement will cause the display brightness of the first display area to be inconsistent with that of the second display area. Specifically, compared with the second display area, the first display area presents low brightness and poor visual effects in a display image thereof.

Confronted with the above technical situation, how to improve the display quality of the display panel arranged with the under-display camera has become an urgent problem to be solved.

The main idea of the present application lies in a possible use of different gamma curves to regulate display voltages in different display areas, allowing for a relatively balanced display brightness of the display areas. That is to say, according to the display method, the display panel, the display control device, the storage medium and the product provided in the present application, by performing the gray-scale conversion on the data to be displayed, for the gray-scale values of the data to be displayed in different display areas on the display panel, the different gamma curves are adopted to perform mapping on the gray-scale values, so as to obtain display voltages available for controlling the display brightness of the display areas. By adopting such a partitioned display control method, it can effectively ensure that a same or similar level of display brightness is maintained for different display areas, especially for a display panel installed with an under-display camera, the display quality is significantly improved.

Detailed description will be made hereunder with specific embodiments to illustrate the technical solutions of the present application and how to solve the above-mentioned technical problems using the technical solutions of the present application. The following specific embodiments can be combined with each other, and for the same or similar concept or process, repetition may be omitted in some embodiments.

It should be noted that the display panel described in the embodiment of the present application may be a display only with a display function, or a display panel provided with an interactive operation function. In addition, the display panel may be a flexible panel with a folding, bending or rolling function; or a traditional panel without a folding, bending or rolling function. Definitely, with the development of technology, the display panel may also be of various new forms.

The display method provided in the embodiments of the present application can be specifically applied to the display panel, where the display panel includes different display areas, that is, the first display area and the second display area.

It should be noted that the first display area and the second display area are concepts of relative areas, the layout positions and specific size division of the two display areas on the display panel can be determined according to actual situations, and the embodiment of the present application does not impose any restriction on this.

For example, in an actual layout of the display panel, the first display area is an area where the under-display camera is arranged, and can be a transparent area; and the second display area is an area where no under-display camera is arranged on the display panel, and can be a non-transparent area. Definitely, in other layout modes, the second display area is an area where the under-display camera is arranged, while the first display area is an area where no under-display camera is arranged on the display panel.

In the embodiments of the present application, for ease of description, illustrations will be made using an example where the first display area is the area where the under-display camera is arranged and the second display area is the area where no under-display camera is arranged.

Figure 2:
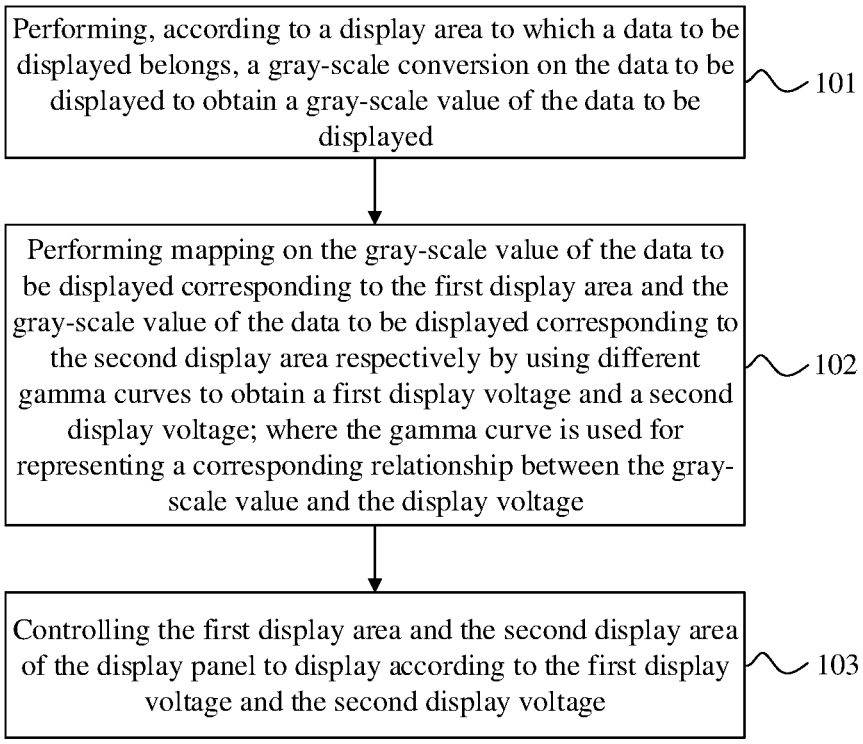
FIG. 2 is a schematic flow diagram of a display method according to an embodiment of the present application.

FIG. 2 is a schematic flow diagram of a display method according to an embodiment of the present application. As shown in FIG. 2, the display method includes:

Step 101, performing, according to a display area to which a data to be displayed belongs, a gray-scale conversion on the data to be displayed to obtain a gray-scale value of the data to be displayed;

Step 102, performing mapping on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage; and Step 103, controlling the first display area and the second display area of the display panel to display according to the first display voltage and the second display voltage, so that the display brightness of the first display area is the same as or similar to that of the second display area.

Specifically, the execution subject of the display method provided in the present embodiment can be in particular a display control device, which includes, but is not limited to hardware devices such as a controller, a control device, a control logic circuit, a control chip, etc., and which may also include software installed on the hardware device implemented based on the instructions. The execution subject is not limited in the embodiments of the present application with regard to its specific form.

First, the display control device obtains data to be displayed, where the data to be displayed is sent to the display panel by a core processing unit of the display device on which the display panel is based. Generally, the data to be displayed includes data information corresponding to each pixel of the display panel and information such as light-emitting timing.

After obtaining the data to be displayed, the display control device firstly determines a display area to which the data to be displayed belongs. That is, the data to be displayed in the first display area and the data to be displayed in the second display area are distinguished to facilitate subsequent processing.

Subsequently, the display control device performs a gray-scale conversion method for the data to be displayed, to obtain a gray-scale value of the data to be displayed. Then, mapping is performed on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage, the first display voltage is a display voltage of the first display area, and the second display voltage is a display voltage of the second display area.

The gray-scale value is an attribute which is used to distinguish the display gray-scale. The display effect of pixels can be well improved by determining and adjusting the gray-scale values thereof. In order to facilitate the adjustment of the display voltages by using the gray-scale values, in the embodiment of the present application, the different gamma curves are used to map the gray-scale values and display voltages of different display areas, so that displaying is enabled with different display voltages for different display areas, thus diversified display brightness can be adopted according to the characteristics of different display areas, thereby ensuring that the display brightness of the whole display panel is balanced and improving the display quality.

The principles and implementations of the display method provided in the embodiments of the present application will be further described below in conjunction with the accompanying drawings.

Figure 3:
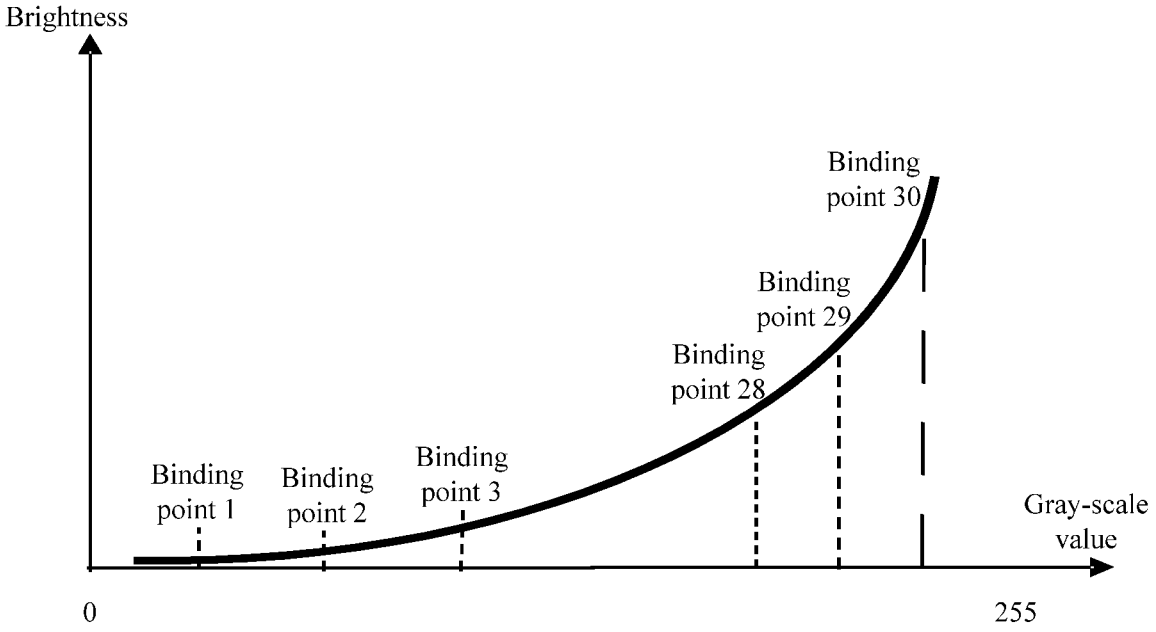
FIG. 3 is a schematic curve diagram of a gamma curve according to an embodiment of the present application.

FIG. 3 is a schematic curve diagram of a gamma curve according to an embodiment of the present application. As shown in FIG. 3, the gamma curve is a curve that can be used to determine a corresponding relationship between gray-scale values and brightness (display voltages).

Generally, when display panels leave the factory, each of the display panels has its own factory gamma curve, and in order to ensure the display effect of the display panel, a standard target gamma curve will be used to correct the factory gamma curve of the display panel to a certain extent before the display panel leaves the factory, so that the corrected gamma curve and the target gamma curve can be kept as similar as possible.

The target gamma curve can be specifically a curve commonly used in the display industry, which is generally associated with the gray-scale values and the maximum brightness. When the gray-scale range is 1-255, the target gamma curve can be expressed as: $y=(n/255)^{2.2}*Y$;

where n is a gray-scale value, y is brightness under the gray-scale value n; and Y is the maximum brightness of the display panel.

Let n=1, 2 . . . 255 be taken into the formula in turn, a curve showing the corresponding relationship between the gray-scale values and the brightness (the display voltages) (as shown in FIG. 3) may be obtained, and the curve constitutes the above-mentioned target gamma curve.

In actual products, a set of registers for storing the gamma curve is set separately in the display control device. When the display panel leaves the factory, the factory gamma curve is stored in the registers. By using the aforementioned target gamma curve, the values of each curve stored in the register can be corrected to make the stored gamma curve approach the target gamma curve to obtain the aforementioned preset gamma curve.

In the present application, in order to make different display areas correspond to different gamma curves, in one of the optional embodiments, the display method further includes:

Step 104, performing a segmentation on a preset gamma curve to obtain a plurality of gamma curves corresponding to different display areas.

Specifically, the preset gamma curve stored in the display control device will also be segmented to form a plurality of gamma curves corresponding to different display areas.

On the basis of the preset gamma curve shown in FIG. 3, the display control device segmentally performs a segmentation on the curve according to the curve smoothness of the preset gamma curve to obtain N curve segments of the preset gamma curve, where N is a positive integer and an even number, such as 30 curve segments shown in FIG. 3.

Further, the segmentation can be performed based on the binding points of the gamma curve. The preset gamma curve of gray-scale reaching 255 is segmented into several curve segments, and the position of the division point is called a binding point.

The position setting of the binding points is usually made with reference to the smoothness of the gamma 2.2 curve. For the smooth part of the gamma curve (i.e. the brightness changes slightly with gray-scale values), the number of segmented binding points is small, that is, the number of gray-scale values in the interval between the binding points is large and the distribution of the binding points is relatively scattered, such as in FIG. 3, the binding point 1, the binding point 2 and the binding point 3, etc.

In addition, for the part of the gamma curve where the brightness changes significantly with gray-scale values, the number of segmented binding points is large, that is, the number of gray-scale values in the interval between the binding points is small and the distribution of the binding points is relatively dense, such as in FIG. 3, the binding point 28, the binding point 29 and the binding point 30, etc.

By comparison, it can be seen that in FIG. 3, the number of gray-scale values in the interval between binding point 1, binding point 2, and binding point 3 (that is, the distance between the binding points on the horizontal axis) is greater than the number of gray-scale values in the interval between binding point 28, binding point 29, and binding point 30.

Figure 4:
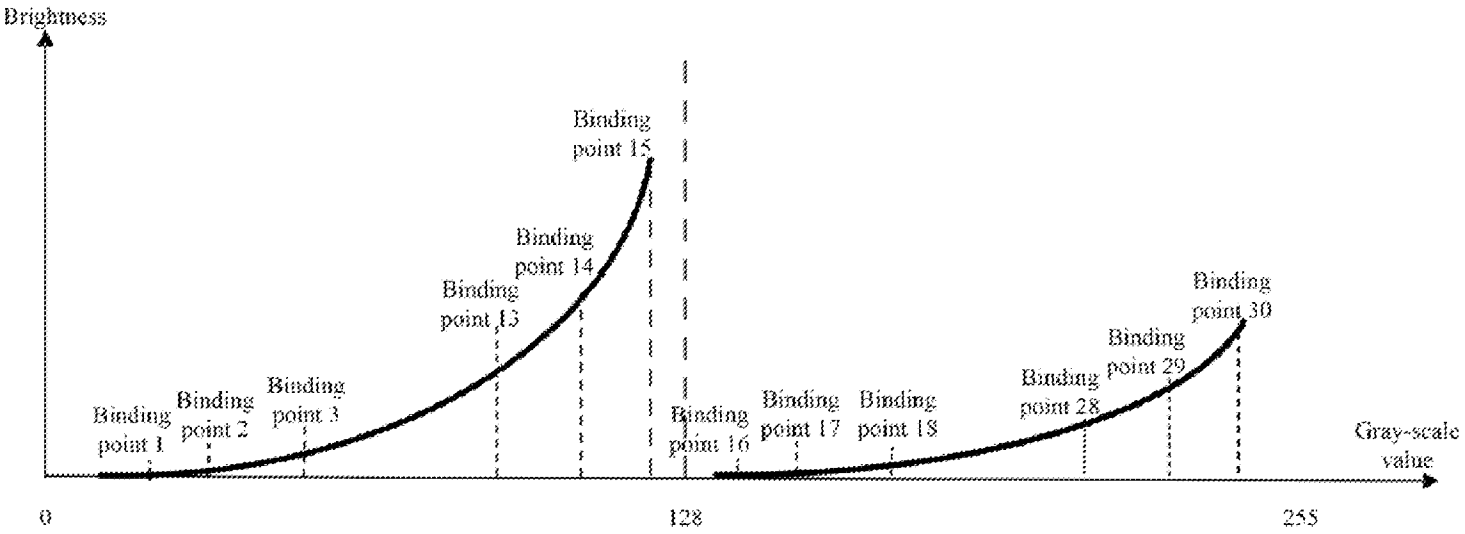
FIG. 4 is a schematic curve diagram of a gamma curve according to an embodiment of the present application.

Then, the display control device groups the curve segments. FIG. 4 is a schematic diagram of a gamma curve according to an embodiment of the present application. In the schematic diagram of the gamma curve shown in FIG. 4, the 1-st to 15-th curve segments constitute the gamma curve of the first display area, while the 16-th to 30-th curve segments constitute the gamma curve of the second display area. That is, the 1-st curve segment to the (N/2)-th curve segment constitute the gamma curve of the first display area, while the (N/2+1)-th curve segment to the N-th curve segment constitute the gamma curve of the second display area.

Then, the entire gamma curve needs to be translated in the dimension of the brightness (display voltages), so that the two gamma curves remain similar brightness (display voltage).

In actual use, the above-mentioned two gamma curves are obtained by performing a segmentation on the preset gamma curve (gray-scale reaching 255), that is, in each of the gamma curves, its corresponding gray-scale is incomplete.

As shown in FIG. 4, the curve is based on the gamma curve of the first display area constituted by the 1-st curve segment to the 15-th curve segment, that is, the curve corresponds to the brightness from the gray-scale value of 128 to the gray-scale value of 255 in the preset gamma curve. That is to say, the origin of the abscissa (gray-scale values) of the curve is 128 instead of 0.

However, the gray-scale value of the data to be displayed in the first display area that are acquired by the display control device cannot be determined, which may be within the range of the gamma curve of the first display area, such as 244, or may exceed the range of the gamma curve of the first display area, such as 100.

Therefore, in the present embodiment, in order to avoid the problem of exceeding the range of gray-scale values of the gamma curve, description is made by taking an example where the first display area is an area where an under-display camera is arranged; when the display control device obtains the data to be displayed in the first display area, the gray-scale value of the data to be displayed will be halved to obtain a first processing result. Then, a preset constant is added on the basis of the first processing result to obtain a second processing result, where the second processing result is a processed gray-scale value, so that the processed gray-scale value may be within the range of gray-scale values of the gamma curve of the first display area. The preset constant may be an intermediate value of all gray-scale values, for example, if all gray-scale values include a total of 256 values from 0 to 255, the intermediate value is the 128-th gray-scale value, that is, the preset constant can be 127.

For example, the aforementioned gray-scale value of 245 will become 244/2+127=249. For another example, the aforementioned gray-scale value of 100 will become 100/2+127=177.

Similarly, as shown in FIG. 4, the curve is based on the gamma curve of the second display area constituted by the 16-th curve segment to the 30-th curve segment, that is, the curve corresponds to the brightness from the gray-scale value of 1 to the gray-scale value of 127 in the preset gamma curve. That is to say, the origin of the abscissa (gray-scale values) of the curve is 0.

However, the gray-scale values of the data to be displayed in the second display area that are acquired by the display control device cannot be determined, which may be within the range of the gamma curve of the second display area, such as 4, or may exceed the range of the gamma curve of the first display area, such as 144.

Therefore, in the present embodiment, in order to avoid the problem of exceeding the range of gray-scale values of the gamma curve, description is made by taking an example where the second display area is an area other than the area where the under-display camera is arranged; when the display control device obtains the data to be displayed in the second display area, the gray-scale value of the data to be displayed will be halved to obtain a third processing result, where the third processing result is a processed gray-scale value, so that the processed gray-scale value may be within the range of gray-scale values of the gamma curve of the second display area.

For example, the aforementioned gray-scale value of 4 will become 4/2=2. For another example, the aforementioned gray-scale value of 144 will become 144/2=72.

Therefore, in the present embodiment, the display control device will also determine, according to the display area to which the data to be displayed belongs, an algorithm of the gray-scale conversion corresponding to the display area; and perform the gray-scale conversion on a current gray-scale value of the data to be displayed by using the algorithm of the gray-scale conversion to obtain the gray-scale value of the data to be displayed.

In one implementation of the product structure, the first display area is the area where the under-display camera is arranged, and the second display area is the area where no under-display camera is arranged, so the first display voltage of the first display area is higher than the second display voltage of the second display area.

According to the display method provided in the present application, by performing the gray-scale conversion on the data to be displayed, for the gray-scale values of the data to be displayed in different display areas on the display panel, the different gamma curves are adopted to perform mapping on the gray-scale values, so as to obtain display voltages available for controlling the display brightness of the display areas. By adopting such a partitioned display control method, it can effectively ensure that a same or similar level of display brightness is maintained for different display areas, especially for a display panel installed with an under-display camera, the display quality is significantly improved.

Figure 5:
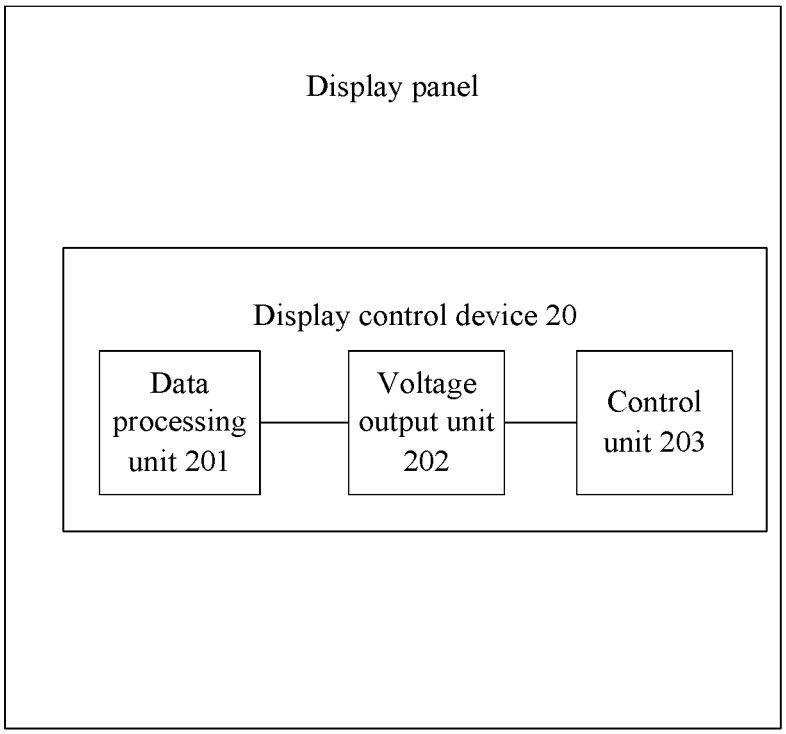
FIG. 5 is a schematic structural diagram of a display control device according to an embodiment of the present application.

FIG. 5 is a schematic structural diagram of a display control device according to an embodiment of the present application. As shown in FIG. 5, the display control device 20 is configured to control a display panel to display, where the display panel includes a first display area and a second display area.

The display control device 20 includes:

a data processing unit 201, configured to perform, according to a display area to which a data to be displayed belongs, a gray-scale conversion on the data to be displayed to obtain a gray-scale value of the data to be displayed;

a voltage output unit 202, configured to perform mapping on the gray-scale value of the data to be displayed corresponding to the first display area and the gray-scale value of the data to be displayed corresponding to the second display area respectively by using different gamma curves to obtain a first display voltage and a second display voltage; where the gamma curve is used for representing a corresponding relationship between the gray-scale value and the display voltage; and a control unit 203, configured to control the first display area and the second display area of the display panel to display according to the first display voltage and the second display voltage, so that the display brightness of the first display area is the same as or similar to that of the second display area.

In an optional embodiment, the display panel is a display panel with an under-display camera. The first display area is an area where an under-display camera is arranged, and the second display area is an area where no under-display camera is arranged.

Accordingly, the first display voltage of the first display area is higher than the second display voltage of the second display area.

In an optional embodiment, the data processing unit 201 is specifically configured to: determine, according to the display area to which the data to be displayed belongs, an algorithm of the gray-scale conversion corresponding to the display area; and perform the gray-scale conversion on a current gray-scale value of the data to be displayed by using the algorithm of the gray-scale conversion to obtain the gray-scale value of the data to be displayed.

In an optional embodiment, further included is a gamma curve processing module, which is specifically configured to perform a segmentation on a preset gamma curve to obtain a plurality of gamma curves corresponding to different display areas.

In an optional embodiment, the gamma curve processing module is further specifically configured to: segmentally perform a segmentation on the curve according to a curve smoothness of the preset gamma curve to obtain N curve segments of the preset gamma curve, where N is a positive integer and an even number;

constitute a gamma curve of the first display area from the 1-st curve segment to (N/2)-th curve segment; and constitute a gamma curve of the second display area from the (N/2+1)-th curve segment to the N-th curve segment.

In an optional embodiment, the gamma curve processing module is further specifically configured to: acquire a factory gamma curve of the display panel; and correct the factory gamma curve by using a target gamma curve to obtain the preset gamma curve.

According to the display control device provided in the present application, the display panel includes a first display area and a second display area, and the display control device includes: the data processing unit, configured to perform, according to a display area to which a data to be displayed belongs, a gray-scale conversion on the data to be displayed to obtain a gray-scale value of the data to be displayed; the voltage output unit, configured to perform mapping on the gray-scale value of the data to be displayed corresponding to the first display area and the gray-scale value of the data to be displayed corresponding to the second display area respectively by using different gamma curves to obtain a first display voltage and a second display voltage, where the gamma curve is used for representing a corresponding relationship between the gray-scale value and the display voltage; and the control unit, configured to control the first display area and the second display area of the display panel to display according to the first display voltage and the second display voltage, so that the display brightness of the first display area is the same as or similar to that of the second display area. By performing the gray-scale conversion on the data to be displayed, for the gray-scale values of the data to be displayed in different display areas on the display panel, the different gamma curves are adopted to perform mapping on the gray-scale values, so as to obtain display voltages available for controlling the display brightness of the display areas. By adopting such a partitioned display control method, it can effectively ensure that a same or similar level of display brightness is maintained for different display areas, especially for a display panel installed with an under-display camera, the display quality is significantly improved.

Figure 6:
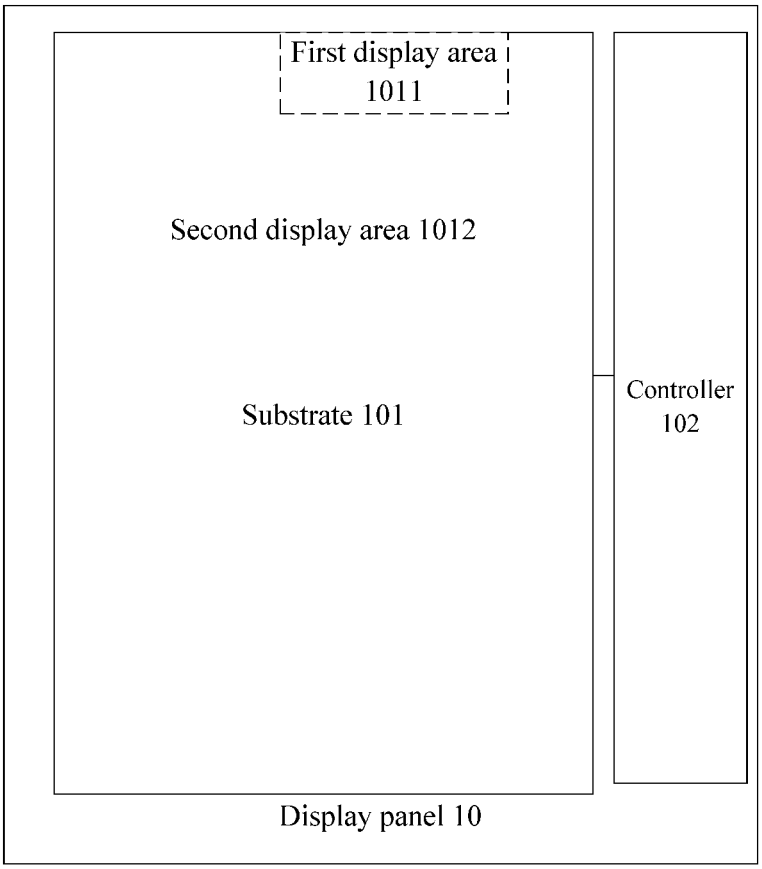
FIG. 6 is a schematic structural diagram of a display panel according to an embodiment of the present application.

FIG. 6 is a schematic structural diagram of a display panel according to an embodiment of the present application. As shown in FIG. 6, the display panel 10 includes:

a substrate 101, including a first display area 1011 and a second display area 1012;

a controller 102, configured to control the first display area 1011 and the second display area 1012 on the substrate to display by using the display method described in any item above.

In an optional embodiment, the display panel 10 is a display panel with an under-display camera; the first display area 1011 is an area where the under-display camera is arranged, and the second display area 1012 is an area where no under-display camera is arranged.

Accordingly, the first display voltage of the first display area 1011 is higher than the second display voltage of the second display area 1012.

The display panel provided in the present application includes the substrate including a first display area and a second display area; and the controller configured to control the first display area and the second display area on the substrate to display by using the display method, where the display method includes performing, according to a display area to which a data to be displayed belongs, a gray-scale conversion on the data to be displayed to obtain a gray-scale value of the data to be displayed; performing mapping on the gray-scale value of the data to be displayed corresponding to the first display area and the gray-scale value of the data to be displayed corresponding to the second display area respectively by using different gamma curves to obtain a first display voltage and a second display voltage, where the gamma curve is used for representing a corresponding relationship between the gray-scale value and the display voltage; and controlling the first display area and the second display area of the display panel to display according to the first display voltage and the second display voltage, so that the display brightness of the first display area is the same as or similar to that of the second display area. By performing the gray-scale conversion on the data to be displayed, for the gray-scale values of the data to be displayed in different display areas on the display panel, the different gamma curves are adopted to perform mapping on the gray-scale values, so as to obtain display voltages available for controlling the display brightness of the display areas. By adopting such a partitioned display control method, it can effectively ensure that a same or similar level of display brightness is maintained for different display areas, especially for a display panel installed with an under-display camera, the display quality is significantly improved.

Figure 7:
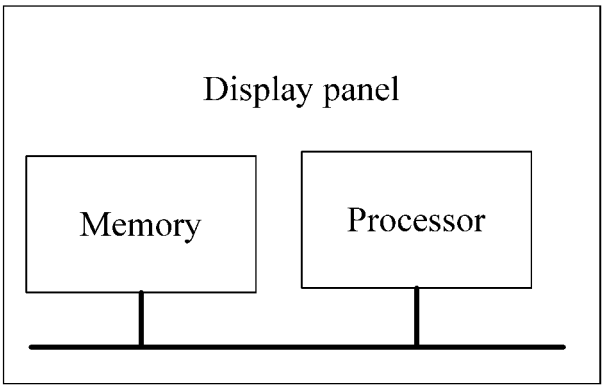
FIG. 7 is a schematic hardware diagram of a display panel according to an embodiment of the present application.

In addition, FIG. 7 is a schematic hardware diagram of a display panel according to an embodiment of the present application. As shown in FIG. 7, the present application further provides a display panel, which includes at least one processor and at least one memory;

the memory stores computer-executable instructions;

the at least one processor executes the computer-executable instructions stored in the memory, so that the at least one processor executes the display method as described above.

Furthermore, the present application provides a computer-readable storage medium, where the computer-readable storage medium stores a computer-executable instruction, and when a processor executes the computer-executable instruction, the display method as described above is implemented.

The present application also provides a computer program product including computer instructions for causing a computer to execute the display method as described above.

In several embodiments provided in the present application, it should be understood that the disclosed device and method can be implemented in other ways. For example, the device embodiments as described above are only schematic, for example, the division of modules is only a logical function division, and there may be other ways of division in actual implementation, for example, multiple modules or components can be combined or integrated into another system, or some features can be ignored or not implemented. On the other hand, the mutual coupling or direct coupling or communication connection shown or discussed may be indirect coupling or communication connection through some interfaces, devices or modules, and may be in electrical, mechanical or other forms.

The modules described as separated components may or may not be physically separated, and the components displayed as modules may or may not be physical modules, that is, they may be located in one place or distributed to multiple network modules. Some or all modules can be selected according to actual needs to achieve the purpose of the present embodiments.

In addition, functional modules in the embodiments of the present application can be integrated in one processing module, or each module can exist physically alone, or two or more modules can be integrated in one module. The above-mentioned integrated modules can be implemented in the form of hardware or hardware plus software functional modules.

Program codes for implementing the method of the present application can be written in any combination of one or more programming languages. These program codes can be provided to a processor or controller of a general-purpose computer, a special-purpose computer or other programmable data processing apparatus, so that the program codes enable the functions/operations specified in the flow chart and/or block diagram to be implemented when executed by the processor or controller. The program codes can be executed completely on the machine, partially on the machine, partially on the machine and partially on the remote machine as a separate software package, or completely on the remote machine or server.

In the context of the present application, a machine-readable medium can be a tangible medium, which can contain or store a program for use by or in connection with an instruction execution system, apparatus or device. The machine-readable medium can be a machine-readable signal medium or a machine-readable storage medium. The machine-readable medium may include, but is not limited to, electronic, magnetic, optical, electromagnetic, infrared, or semiconductor systems, devices or equipment, or any suitable combination of the foregoing. More specific examples of the machine-readable storage media may include electrical connections based on one or more wires, portable computer disks, hard disks, random access memories (RAM), read-only memories (ROM), erasable programmable read-only memories (EPROM or flash memories), optical fibers, portable compact disk read-only memories (CD-ROMs), optical storage devices, magnetic storage devices, or any suitable combination of the above.

Furthermore, although operations are depicted in a particular order, this should be understood as requiring such operations to be performed in the particular order shown or in a sequential order, or requiring that all illustrated operations should be performed to achieve the desired results. Under certain circumstances, multitasking and parallel processing may be beneficial. Similarly, although the above discussion contains a number of specific implementation details, these should not be interpreted as limitations on the scope of the present disclosure. Some features described in the context of separate embodiments can also be implemented in a single implementation in combination. On the contrary, various features described in the context of a single implementation can also be implemented in multiple implementations individually or in any suitable sub-combination.

Although the subject matter has been described in language specific to structural features and/or logical acts of the method, it should be understood that the subject matter defined in the appended claims is not necessarily limited to the specific features or acts described above. On the contrary, the specific features and acts described above are only exemplary forms for implementing the claims.

What is claimed is:

1. A display method, applicable to a display panel comprising a first display area and a second display area, the method comprising:

performing, according to a display area to which a data to be displayed belongs, a gray-scale conversion on the data to be displayed to obtain a gray-scale value of the data to be displayed;

performing mapping on the gray-scale value of the data to be displayed corresponding to the first display area and the gray-scale value of the data to be displayed corresponding to the second display area respectively by using different gamma curves to obtain a first display voltage and a second display voltage; wherein the gamma curve is used for representing a corresponding relationship between the gray-scale value and the display voltage;

controlling the first display area and the second display area of the display panel to display according to the first display voltage and the second display voltage; and performing a segmentation on a preset gamma curve to obtain a plurality of gamma curves corresponding to different display areas;

wherein performing the segmentation on a preset gamma curve to obtain a plurality of gamma curves corresponding to different display areas comprises:

performing a segmentation on the curve according to a curve smoothness of the preset gamma curve to obtain N curve segments of the preset gamma curve, wherein N is a positive integer and an even number;

constituting a gamma curve of the first display area from a 1-st curve segment to a (N/2)-th curve segment among the N curve segments; and constituting a gamma curve of the second display area from a (N/2+1)-th curve segment to a N-th curve segment.

2. The display method according to claim 1, wherein performing, according to a display area to which a data to be displayed belongs, the gray-scale conversion on the data to be displayed to obtain a gray-scale value of the data to be displayed comprises:

determining, according to the display area to which the data to be displayed belongs, an algorithm of the gray-scale conversion corresponding to the display area; and performing the gray-scale conversion on a current gray-scale value of the data to be displayed by using the algorithm of the gray-scale conversion to obtain the gray-scale value of the data to be displayed.

3. The display method according to claim 2, wherein performing the gray-scale conversion on a current gray-scale value of the data to be displayed by using the algorithm of the gray-scale conversion to obtain the gray-scale value of the data to be displayed comprises:

when the display area is an area in which an under-display camera is arranged, halving the gray-scale value corresponding to the display area to obtain a first processing result;

summing the first processing result and a preset constant to obtain a second processing result; and determining the second processing result as the gray-scale value of the data to be displayed.

4. The display method according to claim 2, wherein performing the gray-scale conversion on a current gray-scale value of the data to be displayed by using the algorithm of the gray-scale conversion to obtain the gray-scale value of the data to be displayed comprises:

when the display area is an area where no under-display camera is arranged, halving the gray-scale value corresponding to the display area to obtain a third processing result; and determining the third processing result as the gray-scale value of the data to be displayed.

5. The display method according to claim 1, wherein before performing the segmentation on a preset gamma curve to obtain a plurality of gamma curves corresponding to different display areas, the method further comprises:

acquiring a factory gamma curve of the display panel; and correcting the factory gamma curve by using a target gamma curve to obtain the preset gamma curve.

6. The display method according to claim 1, wherein the display panel is a display panel with an under-display camera;

the first display area is an area in which the under-display camera is arranged, and the second display area is an area in which no under-display camera is arranged; and the first display voltage is higher than the second display voltage.

7. A display control device configured to control a display panel to display, wherein the display panel comprises a first display area and a second display area;

the display control device comprises:

a data processing unit, configured to perform, according to a display area to which a data to be displayed belongs, a gray-scale conversion on the data to be displayed to obtain a gray-scale value of the data to be displayed;

a voltage output unit, configured to perform mapping on the gray-scale value of the data to be displayed corresponding to the first display area and the gray-scale value of the data to be displayed corresponding to the second display area respectively by using different gamma curves to obtain a first display voltage and a second display voltage; wherein the gamma curve is used for representing a corresponding relationship between the gray-scale value and the display voltage; and a control unit, configured to control the first display area and the second display area of the display panel to display according to the first display voltage and the second display voltage;

wherein the display control device is configured to perform a segmentation on a preset gamma curve to obtain a plurality of gamma curves corresponding to different display areas, and the segmentation comprises:

performance of a segmentation on the curve according to a curve smoothness of the preset gamma curve to obtain N curve segments of the preset gamma curve, wherein N is a positive integer and an even number;

constitution of a gamma curve of the first display area from a 1-st curve segment to a (N/2)-th curve segment among the N curve segments; and constitution of a gamma curve of the second display area from a (N/2+1)-th curve segment to a N-th curve segment.

8. The display control device according to claim 7, wherein the display panel is a display panel with an under-display camera;

the first display area is an area in which the under-display camera is arranged, and the second display area is an area in which no under-display camera is arranged; and the first display voltage is higher than the second display voltage.

9. A display panel, comprising:

a substrate, comprising a first display area and a second display area; and a controller, configured to control the first display area and the second display area on the substrate to display by using the display method according to claim 1.

10. The display panel according to claim 9, wherein the display panel is a display panel with an under-display camera; and the first display area is an area in which the under-display camera is arranged, and the second display area is an area in which no under-display camera is arranged; and the first display voltage is higher than the second display voltage.

* * * * *